United States Patent [19]

Lin et al.

[11] Patent Number: 4,571,856

[45] Date of Patent: Feb. 25, 1986

[54] DOUBLE LACED ATHLETIC SHOE

[75] Inventors: Yung-Mao Lin, Taichung, Taiwan; James C. Autry, Dallas, Tex.

[73] Assignee: Autry Industries, Inc., Dallas, Tex.

[21] Appl. No.: 612,720

[22] Filed: May 21, 1984

[51] Int. Cl.[4] ..... A43B 7/20; A43B 7/14; A43B 5/00; A43B 7/08

[52] U.S. Cl. ..... 36/89; 36/114; 36/50; 36/3 A

[58] Field of Search ..... 36/45, 114, 50, 55, 36/88, 3 A, 89, 119

[56] References Cited

U.S. PATENT DOCUMENTS

| | | | |
|---|---|---|---|
| 1,261,152 | 4/1918 | Mullarky | 36/89 |
| 1,286,787 | 12/1918 | Rokahr | 36/114 |
| 1,743,689 | 1/1930 | Scroggins | 36/89 |
| 3,327,410 | 6/1967 | Park, Sr. et al. | 36/114 |
| 3,566,486 | 3/1971 | Conway | 36/114 |
| 3,816,944 | 6/1974 | Jaster | 36/89 |
| 3,970,083 | 7/1976 | Carrigan | 36/89 |
| 4,296,558 | 10/1981 | Antonious | 36/45 |
| 4,342,161 | 8/1982 | Schmohl | 36/114 |
| 4,343,097 | 8/1982 | Sasaki | 36/3 A |
| 4,366,634 | 1/1983 | Gese et al. | 36/114 |

FOREIGN PATENT DOCUMENTS

| | | | |
|---|---|---|---|
| 877639 | 8/1971 | Canada | 36/45 |

*Primary Examiner*—Louis K. Rimrodt
*Assistant Examiner*—Steven N Meyers
*Attorney, Agent, or Firm*—Jerry W. Mills; Gregory M. Howison

[57] ABSTRACT

An athletic shoe includes a sole portion (12) for disposal adjacent the sole of the foot, an upper (14) secured to sole portion (12) about the periphery thereof and cooperating with sole portion (12) to enclose the foot of the wearer and an inner support covering (16) for disposal about the ankle of the foot to provide support therefor. Upper (14) is adapted to overlay the dorsum of the foot and extends upwardly therefrom above the ankle of the foot to provide additional support therefor. Lacing means (36) are provided to adjustably secure upper (14) about the foot of the wearer and a strap (40) is provided to secure the ankle portion of upper (14) about the ankle of the wearer. Inner support covering (16) is attached to sole portion (12) adjacent the inside surface of upper (14) and extends from the lateral side of sole portion (12) to the medial side of sole portion (12) rearwardly around the ankle of the wearer to provide support therefor. Inner support covering (16) extends forwardly over the dorsum of the foot to overlay the metatarsal bones and is split to allow insertion of the foot therein. Lacing means (60) are provided to adjustably secure inner support covering (16) about the foot and ankle of the wearer.

10 Claims, 3 Drawing Figures

DOUBLE LACED ATHLETIC SHOE

TECHNICAL FIELD OF THE INVENTION

The present invention relates generally to athletic shoes and more specifically to a double laced athletic shoe suitable for basketball.

BACKGROUND OF THE INVENTION

Athletic shoes suitable for basketball and other similar sports are well known and typically include a leather or vinyl plastic high top shoe upper for overlaying the dorsum of the foot and which extends upwardly therefrom to surround the ankle and provide support therefor. Because play in basketball and other vigorous sports involves a substantial amount of running and jumping, such ankle support is essential to guard against injury. Present athletic shoes have failed, however, in some instances to provide adequate support and have allowed the ankle to flex excessively during movement. Running related injuries not only to the ankle, but often to the knee and hip, have thus occurred. While previously developed devices have attempted to provide ankle support in an athletic shoe, such prior devices have often been cumbersome and difficult to put on, or take off.

The present invention overcomes the limitations of prior athletic shoes by providing a sports shoe which adequately supports the ankle and thereby eliminates or at least reduces the incidents of running related injuries, but yet which is easily worn and undone.

SUMMARY OF THE INVENTION

The present invention disclosed and described herein comprises an athletic shoe suitable for basketball or other vigorous sports. The athletic shoe comprises a sole portion for disposal adjacent the sole of the foot, and upper attached to the sole portion and cooperating therewith to enclose the foot and an inner support covering positioned adjacent the inside surface of the upper for disposal about the ankle of the foot.

The upper has a central opening for receiving the foot of the wearer and includes lacing apparatus for adjustably securing the upper about the foot of the wearer. In the preferred embodiment, the upper is of high top design and extends upwardly from the dorsum of the foot above the ankle to provide support therefor. A strap is provided on the upper proximate its topmost edge to secure the upper about the ankle of the wearer.

The inner support covering is attached to the sole and extends from the lateral side of the sole to the medial side thereof rearwardly about the ankle of the foot to surround the ankle and provide support therefor. The inner support covering is open adjacent the dorsum of the foot to receive the foot of the wearer and includes lacing apparatus for adjustably securing the inner support covering about the foot and ankle of the wearer.

BRIEF DESCRIPTION OF THE DRAWINGS

For a more complete understanding of the present invention and the advantages thereof, reference is now made to the following detailed description taken in conjunction with the accompanying Drawings in which.

DETAILED DESCRIPTION OF THE INVENTION

Figure 1:
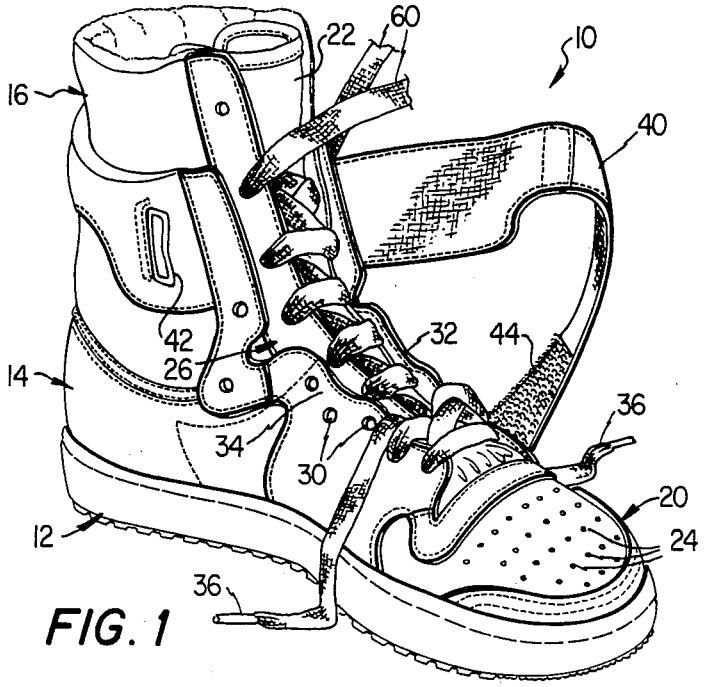
FIG. 1 is a perspective view of the athletic shoe of the present invention illustrating the lacing assembly and strap partially unfastened.

Referring to the Drawings wherein like reference numerals designate like or corresponding parts throughout the views, FIG. 1 illustrates a perspective representation of the athletic shoe of the present invention. The athletic shoe 10 comprises a sole portion 12, an upper 14 and a inner support covering 16. The components of shoe 10 are formed from conventional materials, such as leather or vinyl plastic.

Sole portion 12 is designed for disposal beneath the sole of the wearer's foot and carries a tread or other patterned surface on the undersurface thereof for gripping and traction.

Upper 14 is secured to sole portion 12 about the periphery thereof by stitching or glue and cooperates with sole portion 12 to enclose the foot of the wearer. Upper 14 includes a toe cap 20 disposed adjacent the forward edge of sole portion 12 overlaying the toes of the wearer and a tongue 22 attached to and extending upwardly from toe cap 20. In the preferred embodiment, a plurality of apertures 24 are uniformly distributed over the surface of toe cap 20 to admit air into the shoe closure to cool the enclosed area and thereby provide increased comfort to the wearer.

Upper 14 also includes a central opening or slit 26 which extends rearwardly and vertically from the cap 20 for receiving the foot of the wearer. The edges 32 and 34 of opening 26 are reinforced with increased thicknesses. Eyelets 30 are positioned along the edges 32 and 34 of upper 14 to the left and right of opening 26. A first set of laces 36 is provided and extends between split edges 32 and 34 to adjustably secure upper 14 about the foot of the wearer. The laces 36 are attached to the lowermost opposed pair of eyelets 30 and then criss-crossed into the other eyelets 30 in the conventional manner.

In the preferred embodiment, upper 14 is of a high top design and thus extends over the dorsum of the foot and upwardly therefrom to surround the ankle of the foot. The portion of upper 14 covering the ankle of the foot is preferably padded to provide cushion for the ankle.

A flexible strap 40 extends between edges 32 and 34 proximate the topmost edge of upper 14 to secure upper 14 about the ankle. Strap 40 is fixedly secured at one end to the lateral side of upper 14 proximate edge 32. A buckle 42 is attached on the medial side of upper 14 proximate edge 34 and is dimensioned to receive strap 40. In use, strap 40 is extended from the lateral side of upper 14 across opening 26 and passed through buckle 42. Strap 40 is then folded back upon itself and secured to upper 14 on the lateral side thereof as shown in FIG. 2.

Figure 2:
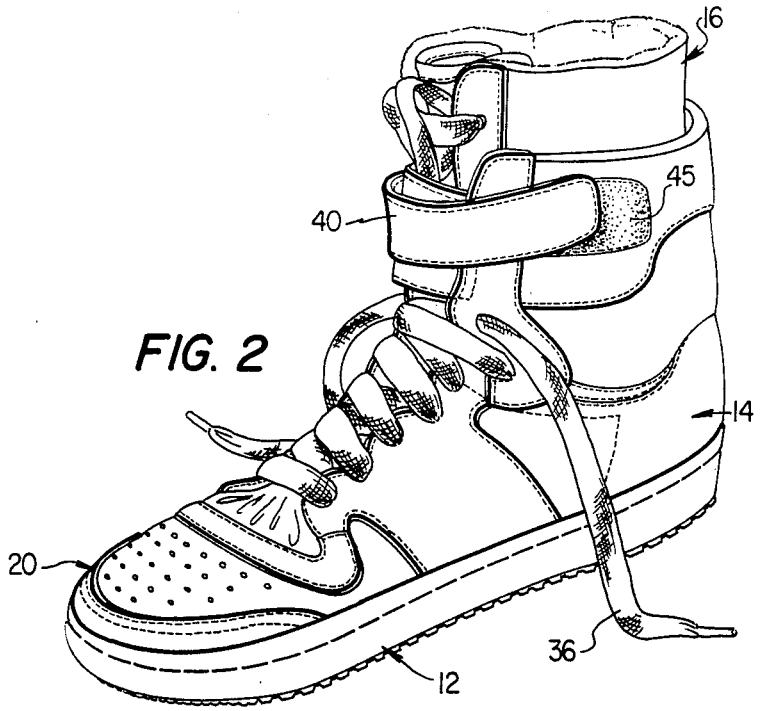
FIG. 2 is a perspective view similar to FIG. 1 but illustrating the lacing assembly and strap fully fastened.

In the preferred embodiment, releasable contact fastening apparatus 44 is provided on the outer surface of strap 40 at the forward end thereof which is adapted to be releasably secured to corresponding contact fastening apparatus 45 positioned on the lateral outer surface of upper 14 (FIG. 2). Fastening apparatuses 44 and 45 preferably are constructed from materials known by the trademark "Velcro". Strap 40 can be releasably fastened to upper 14 by first inserting the end of strap 40 through the buckle 42 and by folding the end of strap 40 back over opening 26 and offered to fastening apparatus 45 by slight pressure. This action thus adjustably secures upper 14 about the ankle of the wearer. The end of strap 40 may be easily released and the fit of the shoe 10 easily adjusted when desired.

Figure 3:
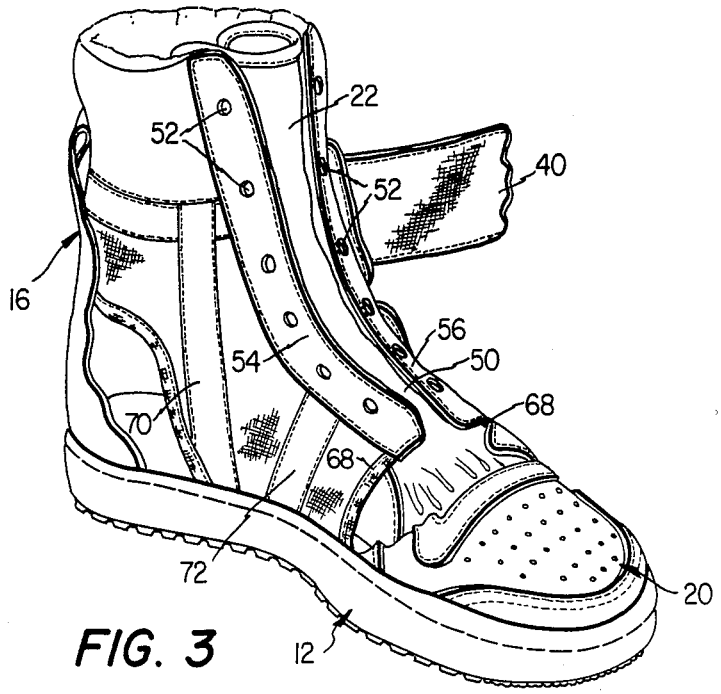
FIG. 3 is a perspective view of the inner support covering of the present invention.

Inner support covering 16 is positioned adjacent the inside surface of upper 14 for disposal about the ankle of the foot and is adjustable thereabout to provide support for the ankle of the wearer. As shown in FIG. 3, inner support covering 16 is attached by stitching or the like to a lateral side of sole portion 12 and extends rearwardly about the ankle of the foot from a point above the heel proximate the Achilles tendon to the medial side of sole portion 12 and is attached thereto to thus encircle the ankle.

Inner support covering 16 extends forwardly over the dorsum of the foot to overlay the metatarsal and cuneiform bones and includes a central opening 50 for receiving the foot of the wearer. The edges 54 and 56 of opening 50 are reinforced by an extra layer. Eyelets 52 are provided along the edges 54 and 56 of inner support 16 adjacent opening 50. Referring again to FIG. 1, a second set of laces 60 is provided and extends between edges 54 and 56 to adjustably secure inner support 16 about the foot and ankle of the wearer. Laces 60 are attached at the lowermost opposed pair of eyelets 52 and then criss-crossed into the other eyelets 52 in the conventional manner.

Inner support covering 16 terminates at front ends 68 and covers the tongue 22. Covering 16 may thus be tightened independently of upper 14.

With further reference to FIG. 3, reinforcing strips 74 and 72 are positioned on the medial side of inner support covering 16 for reinforcing the vertical stress of the covering. Substantially idential reinforcing strips (not shown) are provided on the lateral side of inner support covering 16.

The construction of the present shoe provides a very comfortable, yet firm support of the wearer's foot and ankle. The double construction of the upper and inner support, in combination with the double lacing, provides selective support of all portions of the foot and ankle. Strap 40 also acts to provide selective tightening and support about the wearer's ankle.

In summary, there is provided an athletic shoe suitable for basketball or the like which includes a sole portion for disposal adjacent the sole of the foot, an upper secured about the periphery of the sole and cooperating therewith to enclose the foot, and an inner support covering for disposal about the ankle of the foot and adjustable thereabout to provide support therefor.

Although the preferred embodiment has been described in detail, it should be understood that various changes, substitutions and alterations can be made therein without departing from the spirit and scope of the invention as defined in the appended claims.

What is claimed is:

1. An athletic shoe comprising:

a sole portion for disposal adjacent the sole of the wearer's foot;

an upper secured about the periphery of said sole portion and cooperating with said sole portion to enclose the foot;

an inner support covering positioned adjacent the inside surface of said upper and secured to said sole portion for disposal about the ankle of the foot and between the foot and said upper comprising:

a lateral portion attached to said sole portion from a point adjacent the cuboid bone to a point adjacent the shaft of the fifth metatarsal bone and extending upwards over the outer malleolus and the lateral side of the dorsum of the foot;

a medial portion attached to said sole portion from the back of the arch to the front of the arch and extending upwards over the inner malleolus and the medial side of the dorsum of the foot;

an achilles portion disposed adjacent said lateral portion and said medial portion extending rearwardly about the leg and ankle above the attachment point of the achilles tendon, such that the calcaneum bone is exposed;

a first medial reinforcing strip secured to said medial portion, attached to said sole at a point corresponding to the back of the arch and extending vertically over the inner malleolus;

a second medial reinforcing strip secured to said medial portion, attached to said sole at a point corresponding to the front of the arch and extending vertically over the shaft of the metatarsal bones;

a first lateral reinforcing strip secured to said lateral portion, attached to said sole at a point opposite said first medial reinforcing strip and extending vertically over the outer malleolus; and a second lateral reinforcing strip secured to said lateral portion, attached to said sole at a point opposite said second medial reinforcing strip and extending vertically over the shaft of the metatarsal bones; and means for tightening the opening formed by the upper edges of said medial portion and said lateral portion.

2. The athletic shoe of claim 1 and further comprising means for independently tightening said upper and said inner support covering about the foot.

3. The athletic shoe of claim 1 and further comprising:

a toe cap disposed adjacent to the forward edge of said sole portion overlaying the toes of the foot of the wearer;

a tongue attached to said toe cap and extending upwardly therefrom;

central openings through said upper and said inner support covering for receiving the foot of the wearer; and means for closing said openings to adjustably secure said upper and said inner support covering about the foot of the wearer.

4. The athletic shoe of claim 3 wherein a plurality of apertures are uniformly distributed over the surface of said toe cap to admit air into the shoe closure.

5. The athletic shoe of claim 1 and further comprising securing means connected to said upper for selectively tightening the upper portions of both said upper and said inner support covering.

6. The athletic shoe of claim 5 wherein said securing means comprises:

a strap secured at one end thereof on a first side of said upper proximate its topmost edge; and a buckle positioned on the opposite side of said upper and dimensioned to receive the other free end of said strap to thus secure said upper about the ankle of the wearer.

7. The athletic shoe of claim 6 and further comprising contact fastening means on the surface of said strap at the free end thereof and corresponding contact fastening means positioned on the surface of said upper on said first side thereof so that when said strap is extended through said buckle, said strap can be folded back upon itself and releasably fastened to said upper to thus secure said upper about the ankle of the wearer.

8. The athletic shoe of claim 1 wherein said tightening means comprises a lace.

9. The athletic shoe of claim 1 wherein said upper extends above the ankle of the foot to provide support therefor, and wherein said inner support covering extends above the top of said upper.

10. The athletic shoe of claim 9 wherein the inner portion of said upper covering the ankle is padded.

* * * * *

UNITED STATES PATENT AND TRADEMARK OFFICE

CERTIFICATE OF CORRECTION

PATENT NO. : 4,571,856

DATED : February 25, 1986

INVENTOR(S) : Yung-Mao Lin, and James C. Autry

It is certified that error appears in the above-identified patent and that said Letters Patent is hereby corrected as shown below:

Col. 2, line 33, "from the cap" should be --from toe cap--.

Col. 3, line 3, "and offered to" should be --and affixed to--.

Signed and Sealed this

*Tenth* Day of *June 1986*

[SEAL]

*Attest:*

DONALD J. QUIGG

*Attesting Officer*

*Commissioner of Patents and Trademarks*